US010731836B2

(12) United States Patent
Tweel et al.

(10) Patent No.: US 10,731,836 B2
(45) Date of Patent: Aug. 4, 2020

(54) LIGHT FIXTURE

(71) Applicant: ABL IP Holding LLC, Decatur, GA (US)

(72) Inventors: Patrick M. Tweel, Atlanta, GA (US); Aaron Feldman, Atlanta, GA (US); Matthew Scott Hoch, McDonough, GA (US); John T. Hickok, Social Circle, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 15/659,975

(22) Filed: Jul. 26, 2017

(65) Prior Publication Data

US 2018/0031216 A1 Feb. 1, 2018

Related U.S. Application Data

(60) Provisional application No. 62/366,850, filed on Jul. 26, 2016.

(51) Int. Cl.

| | |
|---|---|
| ***F21V 21/00*** | (2006.01) |
| ***F21V 21/30*** | (2006.01) |
| ***F21V 21/36*** | (2006.01) |
| ***F21V 21/04*** | (2006.01) |
| ***F21V 15/01*** | (2006.01) |
| ***F21S 8/02*** | (2006.01) |

(52) U.S. Cl.

CPC ..... *F21V 21/30* (2013.01); *F21S 8/026* (2013.01); *F21V 15/01* (2013.01); *F21V 21/04* (2013.01); *F21V 21/36* (2013.01)

(58) Field of Classification Search

CPC ..... F21V 23/009; F21V 23/06; F21V 23/002; F21V 29/503; F21V 21/005; F21S 4/28; F21S 8/036; F21S 8/043

See application file for complete search history.

(56) References Cited

U.S. PATENT DOCUMENTS

| | | | |
|---|---|---|---|
| D130,570 | S | 12/1941 | Borkland |
| D397,819 | S | 9/1998 | Thorton, Jr. |
| 5,988,829 | A | 11/1999 | Holder |
| D496,121 | S | 9/2004 | Santoro |
| D544,992 | S | 6/2007 | Mayfield et al. |
| D561,383 | S | 2/2008 | Hukle et al. |
| 7,490,960 | B1 | 2/2009 | Fiorino et al. |
| D595,894 | S | 7/2009 | Verfuerth et al. |
| D604,000 | S | 11/2009 | Fowler, Jr. et al. |

(Continued)

OTHER PUBLICATIONS

"2x2 2x4 LED Troffer", led-wall-pack.com, site visited May 30, 2017 <http://www.led-wall-pack.com/indoorled-lighting/led-volumetric-troffer-light/2017-newest -etl-dlc-v4-0-rrem iu m-led-ceili ng. html>, 2015 (2 pages).

(Continued)

*Primary Examiner* — Thien T Mai

(74) *Attorney, Agent, or Firm* — Kilpatrick Townsend & Stockton LLP

(57) ABSTRACT

A light fixture that can be built upon itself to scale up or down the lumen output. More specifically, embodiments of the light fixture include an electronic housing flanked on each side with one or more light modules. The fixture can be tailored to the light needs of particular applications by adding or removing light modules from the fixture.

16 Claims, 8 Drawing Sheets

(56) References Cited

U.S. PATENT DOCUMENTS

| | | | | |
|---|---|---|---|---|
| D673,324 | S | 12/2012 | Mayfield, III et al. | |
| D678,597 | S | 3/2013 | Lehman et al. | |
| 8,506,121 | B2 | 8/2013 | Van Laanen et al. | |
| D696,449 | S | 12/2013 | Boyer et al. | |
| D701,341 | S | 3/2014 | Mayfield, III et al. | |
| D703,858 | S | 4/2014 | Miller | |
| 8,956,013 | B1 * | 2/2015 | Shew | F21S 9/022 362/249.02 |
| D729,435 | S | 5/2015 | Arndt et al. | |
| D739,977 | S | 9/2015 | Boyer et al. | |
| D762,909 | S | 8/2016 | Shi | |
| 9,416,954 | B2 | 8/2016 | Miller | |
| D767,193 | S | 9/2016 | Jung | |
| D784,594 | S | 4/2017 | Stolte | |
| D786,471 | S | 5/2017 | Snell et al. | |
| D799,102 | S | 10/2017 | Tweel et al. | |
| D804,077 | S | 11/2017 | Ma et al. | |
| D807,567 | S | 1/2018 | Tweel et al. | |
| D808,575 | S | 1/2018 | Tweel et al. | |
| D809,701 | S | 2/2018 | Tweel et al. | |
| D810,999 | S | 2/2018 | Tweel et al. | |
| D820,496 | S | 6/2018 | Agro | |
| D822,884 | S | 7/2018 | Tweel et al. | |
| D822,885 | S | 7/2018 | Tweel et al. | |
| D822,886 | S | 7/2018 | Tweel et al. | |
| D824,581 | S | 7/2018 | Tweel et al. | |
| 2012/0212956 | A1 | 8/2012 | Chen | |
| 2013/0027935 | A1 * | 1/2013 | Ladewig | F21S 2/00 362/249.01 |
| 2013/0063948 | A1 | 3/2013 | Ishii | |
| 2013/0294072 | A1 | 11/2013 | Miller | |
| 2014/0293595 | A1 * | 10/2014 | May | F21S 9/022 362/218 |
| 2014/0313719 | A1 | 10/2014 | Wang et al. | |
| 2015/0016100 | A1 | 1/2015 | Ishii | |
| 2015/0016108 | A1 | 1/2015 | Howe | |
| 2015/0159839 | A1 | 6/2015 | Howe | |
| 2016/0327256 | A1 * | 11/2016 | Hall | F21V 23/009 |

OTHER PUBLICATIONS

"Albee™ LED Luminaire High Bay Lighting (ABV—Series)", GE Lighting, Feb. 16, 2016, 6 pages.

"Albee™ LED Luminaire Modular High & Low Bay Lighting (ABHX—Series)", GE Lighting Solutions, May 1, 2013, 8 pages.

"Albeo LED Luminaire Heavy Industrial High Bay & Low Bay Lighting (ABRI—Series)", GE Lighting, Retrieved from the internet: www.gelighting.com, 2016, 6 pages.

"Albeo™ LED Luminaire Heavy Industrial High Bay & Low Bay Lighting IABRI—Series)", imagination at work, Retrieved from the internet: www.gelighting.com, 2016, 2 pages.

"Albeo™ LED Luminaire Heavy Industrial High Bay Lighting (ABRI—Series)", GE Lighting, Installation Guide, 2014, 4 pages.

"Announcing the Albeo ABR1 Heavy Industrial High Bay from GE.", GE Lighting, Nov. 20, 2015, 2 pages.

"Award Winning of High Efficacy LED Fixtures for High and Medium Day Applications", Flextronics X, Product Guide, Lusio® Essentials Series v 2.1, 2014, 60 pages.

"Big Ass Light High Bay LED", Retrieved from the internet: bigasslight.com.au, 2015, 3 pages.

"Enjoy flexibility and savings along with quality illumination", LED Solutions, 2015, 8 pages.

"Get more from the top: Experience unmatched energy savings in high and low bay environments with Albeo TM LED Luminaires", Current powered by GE, 2016, 8 pages.

"HBLED High Bay LED Luminaire", Metalux, Eaton Powering Business Worldwide, 2015, 4 pages.

"LED Features and Specification", Orion I SON™ High Bay, orionlighting.com, 2015, 2 pages.

"Low Profile Channel LED Fixture or Retrofit", Industrial Lighting Products, 13 pages.

"Lusio® Essential Aisle Lighter Performance Line", Flex, www.flextronics.com/liqhting,, 2015, 2 pages.

"Lusio® Essential Series Aisle Lighter", Flextronics X, www.flextronics.com/lightinq, 2014, 2 pages.

"Made to order Imaging lighting as versatile as the industries it serves.", Industrial Solutions, 2015, 15 pages.

"Metalux Industrial LED Luminaires", Eaton Powering Business Worldwide, 51 pages.

"The Big Ass Inverted 20K LED", Retrieved from the internet: bigasslight.com, Jun. 24, 2015, 2 pages.

U.S. Appl. No. 29/612,685, "Non-Final Office Action," dated Oct. 17, 2018, 7 pages.

* cited by examiner

LIGHT FIXTURE

CROSS-REFERENCE TO RELATED APPLICATIONS

This application claims the benefit of U.S. Provisional Application No. 62/366,850, filed Jul. 26, 2016 and entitled "Light Fixture," the entirety of which is hereby incorporated by reference.

FIELD

Embodiments of the present invention relate to a light fixture having improved versatility in that the fixture can be scaled up or down with relative ease to tailor the fixture for particular applications.

BACKGROUND

Different light fixtures, such as fixtures having different lumen outputs, are needed for different applications. Challenges arise in designing solutions that easily accommodate this range of options. Oftentimes, different and unique fixtures or fixture parts must be designed and offered, each targeted for a particular application. It would be useful to have a single fixture that could be built upon itself to scale up or down the lumen output.

SUMMARY

Certain embodiments of the present invention provide a light fixture that can be built upon itself to scale up or down the lumen output. More specifically, embodiments of the light fixture include an electronic housing flanked on each side with one or more light modules. Each light module can be (but does not have to be) identical to the others, facilitating manufacturing and assembly. Moreover, the fixture can be tailored to the light needs of particular applications by adding or removing light modules from the fixture.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The Figures illustrate various views of embodiments of light fixture 10 contemplated herein. The light fixture 10 is designed to be suspended from a ceiling (such as with brackets or pendant hanger), but it is also contemplated that the light fixture 10 can be recessed within a ceiling or surface-mounted on the ceiling. Moreover, the light fixture 10 may be provided as an indoor or an outdoor fixture.

Figure 1:
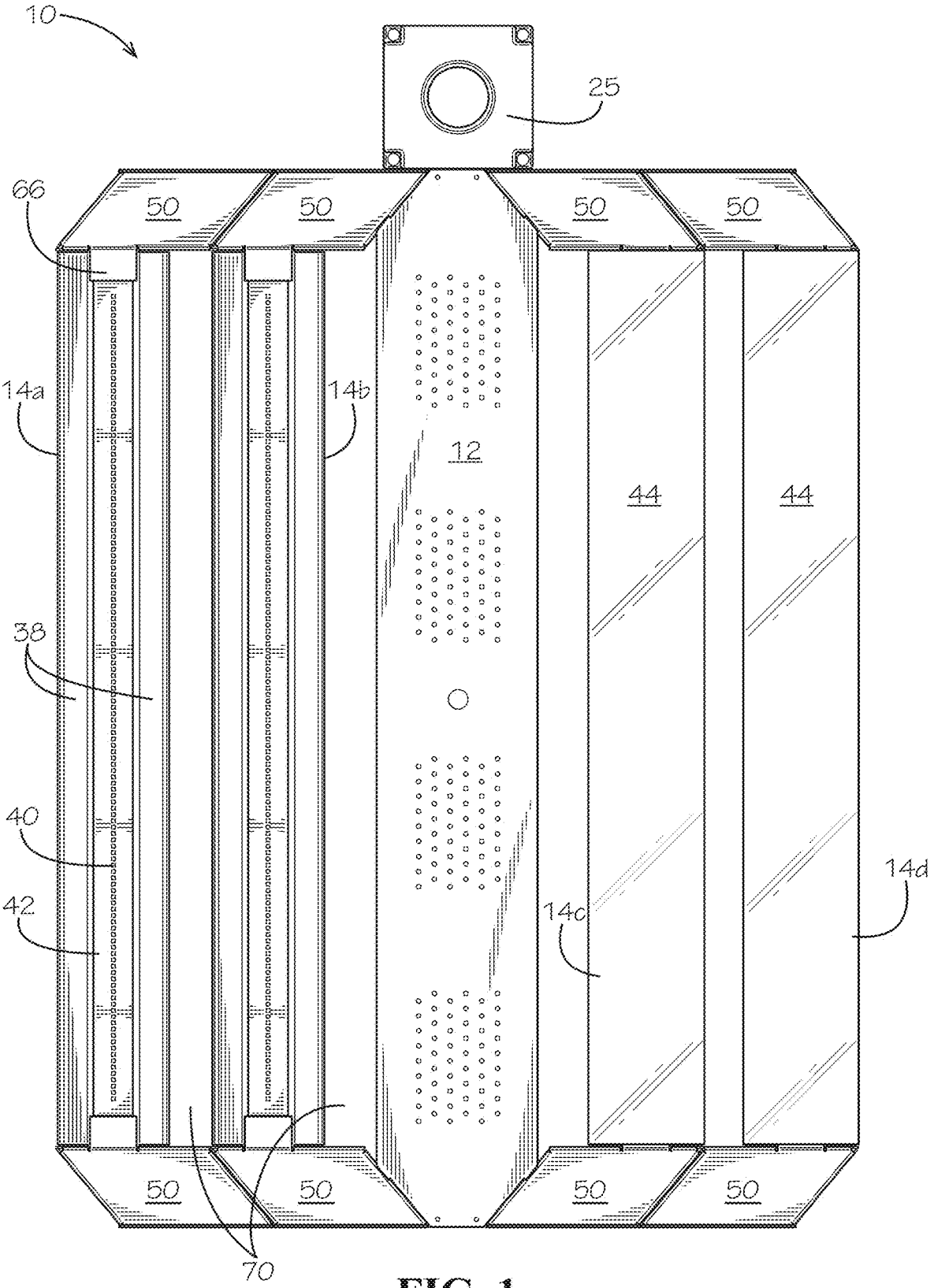
FIG. 1 is a bottom plan view of an embodiment of the light fixture contemplated herein.
Figure 2:
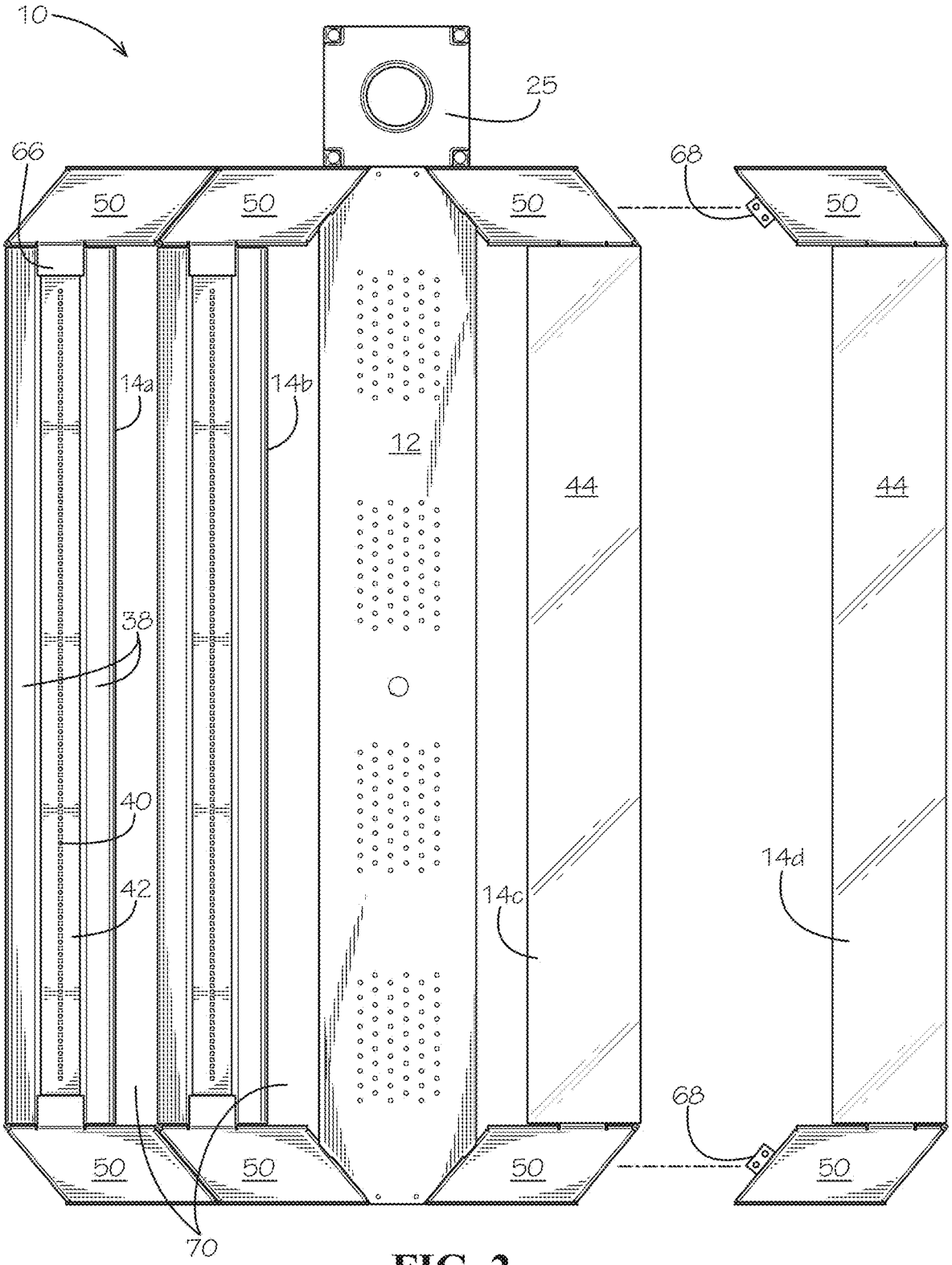
FIG. 2 is a partially exploded view of the light fixture of FIG. 1.

In the illustrated embodiments, the light fixture 10 includes an electronic housing 12 flanked on each side by at least one light module 14. FIGS. 1 and 2 illustrate four light modules 14*a*-14*d*, but any number of light modules may be provided. The electronic housing 12 may house electrical components (e.g., driver, battery pack(s), etc.) that drive the light fixture 10, and, more specifically, power and control the operation of the light modules 14.

Figure 3:
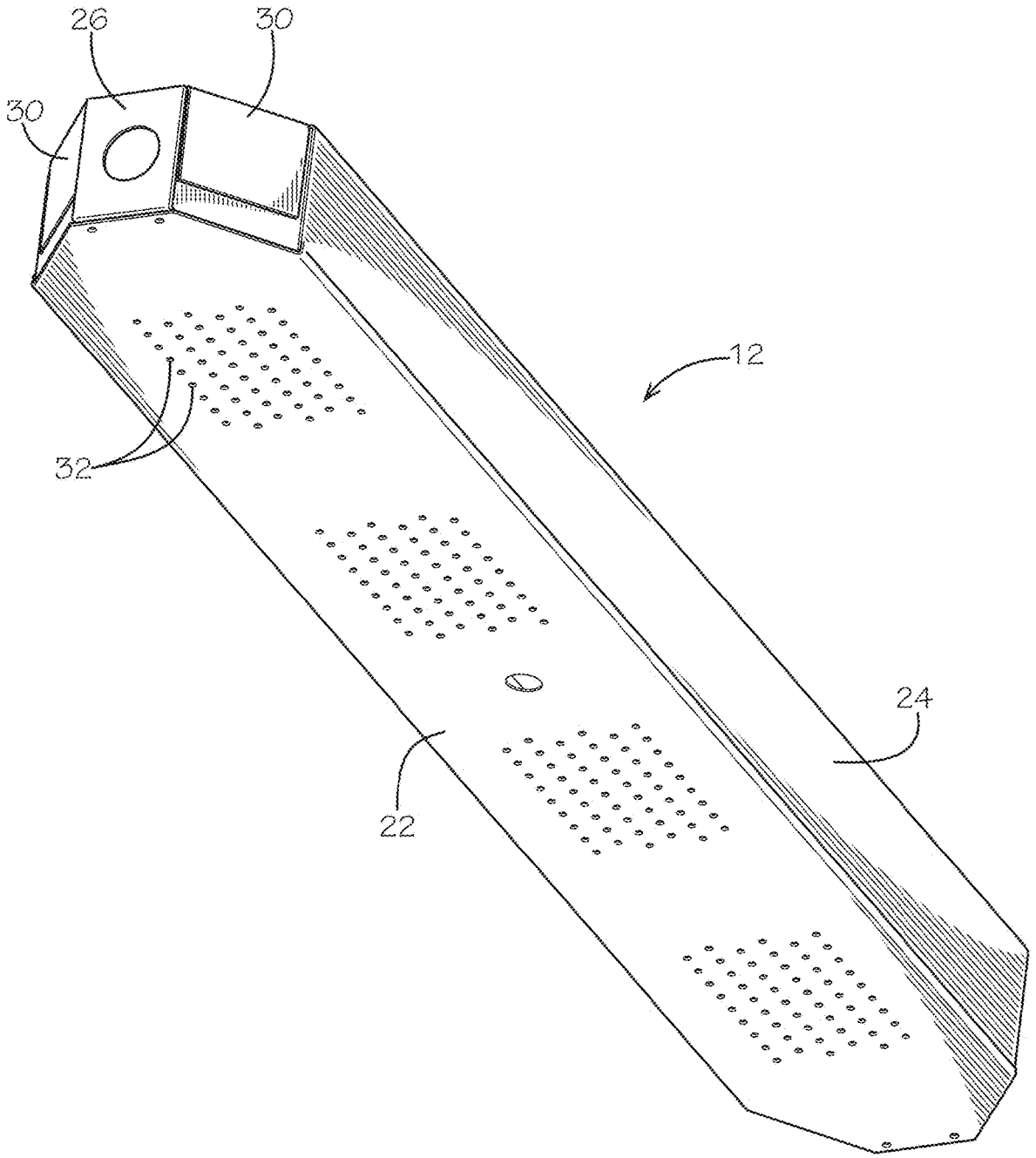
FIG. 3 is a bottom perspective view of the electronic housing of FIG. 1 shown in isolation.
Figure 4:
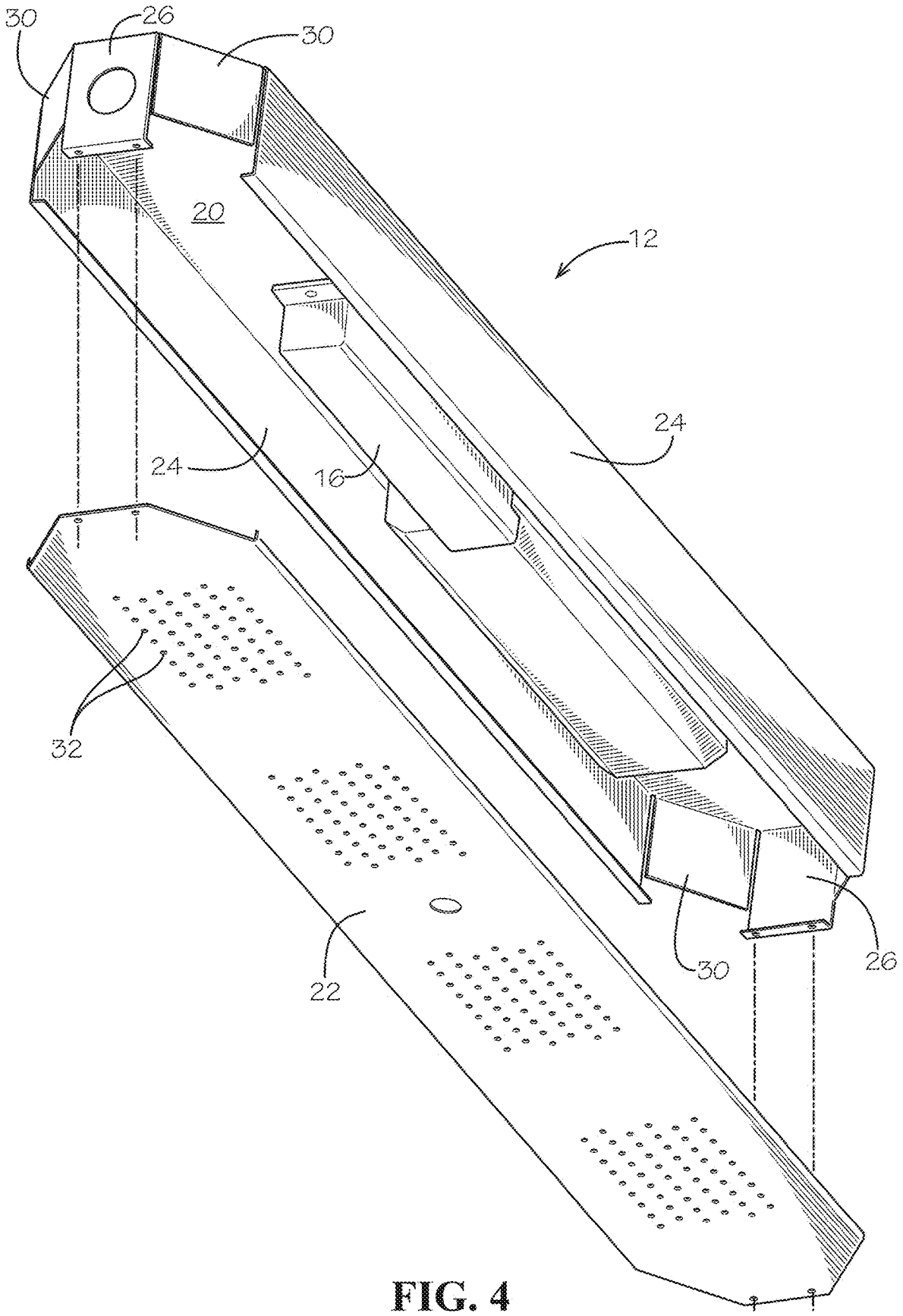
FIG. 4 is an exploded view of the electronic housing shown in FIG. 3.

As illustrated in FIGS. 3 and 4, the electronic housing 12 includes a top wall 20, a bottom wall 22, and side walls 24 and end walls 26 that extend between the top wall 20 and bottom wall 22 to form an enclosure for electrical components. Any or all of the top wall 20, bottom wall 22, side walls 24, and end walls 26 may be formed integrally, or alternatively they may be formed separately and subsequently attached to each other using any suitable mechanical (e.g., screws or other fasteners) or chemical (e.g., adhesive) retention means. For example, it may be advantageous for the bottom wall 22 of the electronic housing 12 to be removable so as to permit access from below to the electronics housed in the electronic housing 12.

The electronic housing 12 may have any shape, including a rectilinear or curved shape. In one embodiment, angled walls 30 connect the side walls 24 and the end walls 26. The angled walls 30 may be oriented at any angle greater than 90°, where the angle is measured between the inner surface of an angled wall 30 and the inner surface of a side wall 24 or an end wall 26.

One or more drivers 16 may be provided in the electronic housing 12, such as by mounting to the top wall 20 of the electronic housing 12. In use, main power comes in through the top wall 20 of the electronic housing 12 and feeds power to the light modules 14, as described below. Communication lines may also feed from the electronic housing 12 to the light modules 14 to independently control each light module 14.

One or more of the end walls 26 may be used for mounting accessories to the light fixture 10, such as, but not limited to, motion sensors 25. Vent holes 32 may be provided in any of the electronic housing walls to effectuate cooling of the electronic housing 12 during use. Any number and arrangement of vent holes 32 may be provided.

Any number of light modules 14 can be added to form the light fixture 10. By way only of example, a single light module 14 may be provided on each side of the electronic housing 12. Alternatively, multiple light modules 14 may be provided on each side of the electronic housing 12 and mechanically connected in series. The innermost light modules 14 (i.e., those closest to the electronic housing—modules 14*b* and 14*c* in the illustrated embodiment) are connected to the electronic housing 12 but subsequent light modules 14 (if provided) may be connected to adjacent light modules 14 to increase the lumen output of the light fixture 10.

Figure 5:
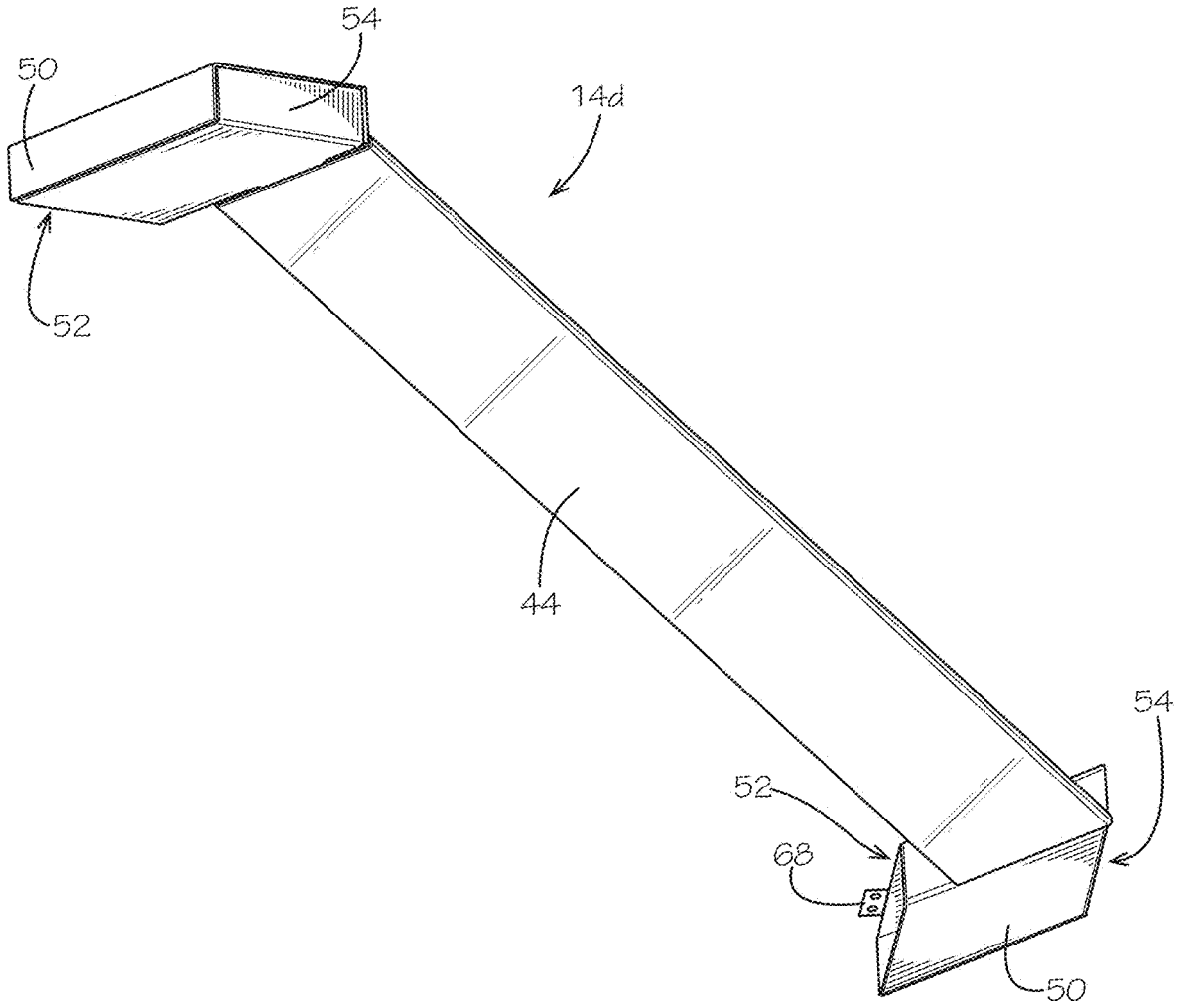
FIG. 5 is a bottom perspective view of light module 14*d* of FIG. 1 shown in isolation.
Figure 6:
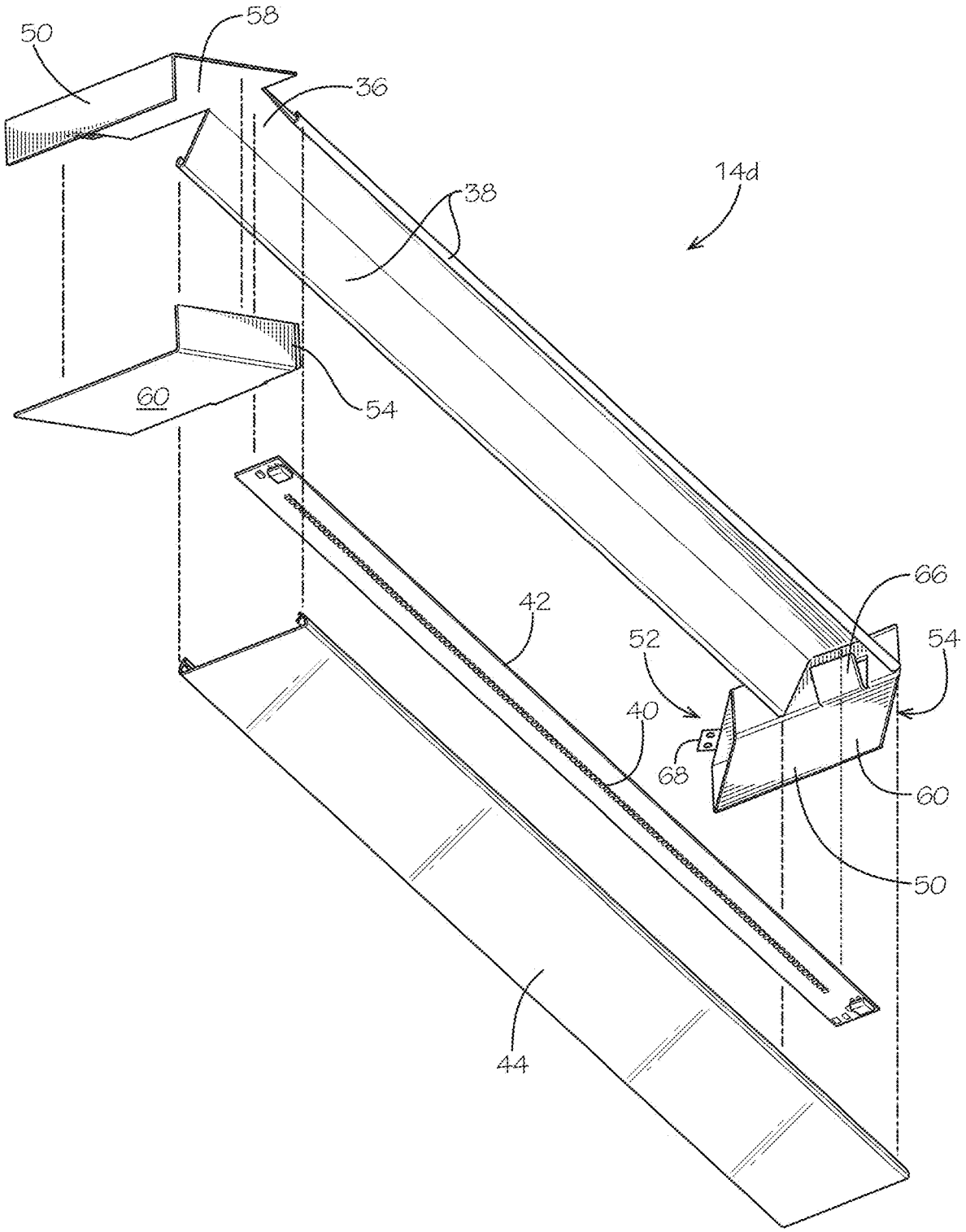
FIG. 6 is a partially exploded view of light module 14*d* shown in FIG. 5.

FIGS. 5 and 6 illustrate light module 14*d* in isolation. However, unless noted otherwise, the basic structure of the other light modules 14*a*-14*c* is the same as light module 14*d*. Each light module 14 includes a light module base 36 from which angled side walls 38 downwardly extend so as to form a trough. The light module base 36 and angled side walls 38 can be formed integrally or separately. The surface of the angled side walls 38 and/or light module base 36 may be highly reflective so as to reflect light emitted by the light emitting diodes ("LEDs").

LEDs 40 are positioned within the trough. In some embodiments, the LEDs 40 are mounted on the light module base 36 of each light module 14. The LEDs 40 may be provided on printed circuit boards 42 ("PCB") that are subsequently mounted within the trough. In other embodiments, no PCB is needed; rather, the LEDs 40 are chip-on-board LEDs 40 provided directly on the light module base 36. The LEDs 40 may be single-die or multi-die LEDs, DC or AC, or can be organic light emitting diodes. White, color, or multicolor LEDs may be used. Moreover, the LEDs need not all be the same color; rather, mixtures of LEDs may be used.

Figure 7:
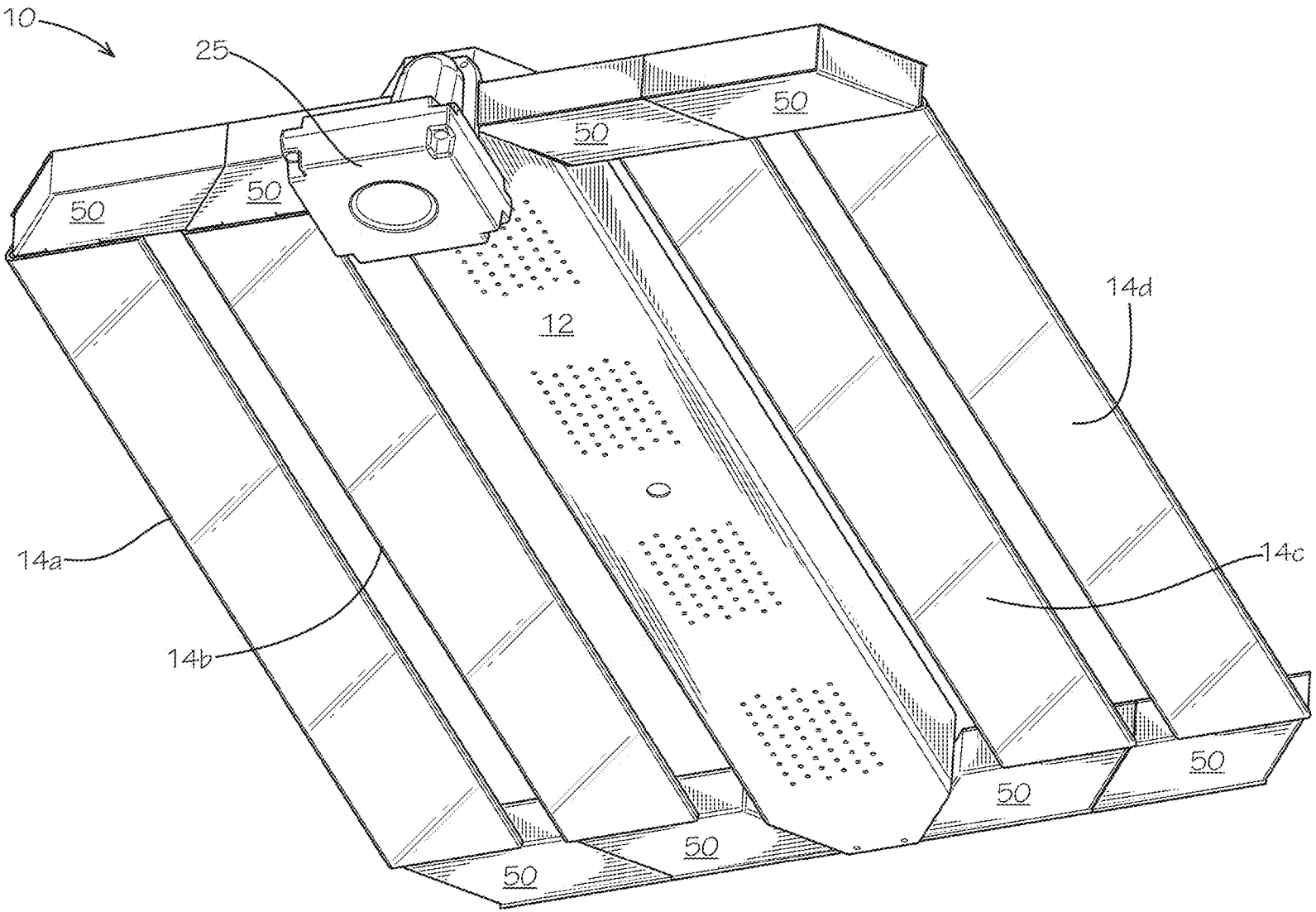
FIG. 7 is a bottom perspective view of the light fixture of FIG. 1.
Figure 8:
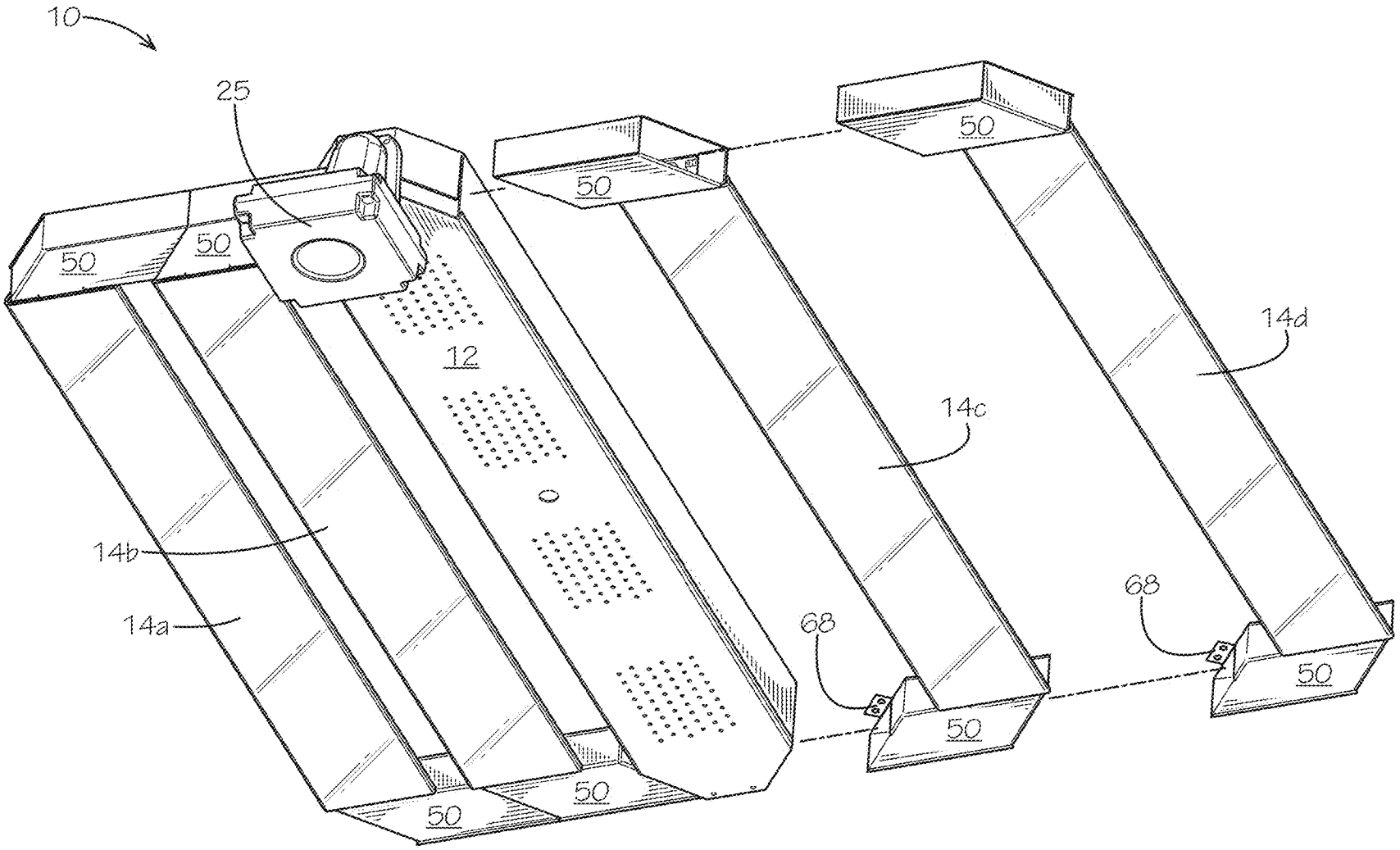
FIG. 8 is a partially exploded view of the light fixture of FIG. 7.

The light fixture 10 may be used as an open fixture (i.e., the light modules 14 remain open and air is free to enter each light module 14 from below) or a optic 44 may be mounted onto the light modules 14 and over the LEDs 40 to enclose each light module 14. In FIGS. 1 and 2, light modules 14*a* and 14*b* are not provided with an optic 44 whereas light modules 14*c* and 14*d* are provided with an optic 44. Removal of the optic 44 from light modules 14*a* and 14*b* is purely for illustrative purposes. In most situations, all of the lights modules 14 on a fixture 10 would either be provided with an optic 44 (as shown in FIGS. 7 and 8) or without an optic 44.

In one embodiment, the optic 44 snap fits onto the distal edges of the angled side walls 38. The optic 44 may be retained in other ways, all of which are well within the knowledge of a person of skill in the art. The optic 44 may serve both as an aesthetic cover and to functionally direct or diffuse light to provide better lighting conditions. The optic 44 may be of any type (diffuse, prismatic, etc.) that achieves the desired light emission from the light fixture 10. The optic 44 may have any geometry and may be provided with any surface enhancements or no surface enhancements.

Module connectors 50 are provided on one end, or on each end, of a light module 14. The module connectors 50 are used to attach the light module(s) 14 onto the light fixture 10. The module connectors 50 may be of any shape or size. In some embodiments, the shape of the module connectors 50 complement the shape of the module connectors 50 of adjacent light modules 14 such that adjacent module connectors 50 abut and/or nest with each other.

In some embodiments, the module connector 50 includes module connector sides 52, 54 and is at least partially hollow so as to define a passageway through the module connector 50. The module connector sides 52, 54 can be fully or partially open such that wires may enter, extend through the passageway, and exit a module connector 50. For example, for light modules 14*b* and 14*c*, both sides 52, 54 of the module connectors 50 may be at least partially open to allow wires to pass into and through the module connectors 50. In contrast, the outermost side 54 of the module connectors 50 of the distal-most light modules 14 in the light fixture 10 may be fully closed. Such is the case with the module connector 50 of light modules 14*a* and 14*d*, whereby the outermost side 54 is closed given that wires do not need to exit those module connectors 50 to feed adjacent light modules 14 and so as to impart a polished appearance to the light fixture 10.

In use, the main power supply enters the electronic housing 12 to power the driver(s) 16 and other electronics housed in the electronic housing 12. Power and/or communication means from the driver (e.g., cables or wires), in turn, are fed into and through the module connectors 50 to power the LEDs 40 residing in each light module 14. In this way, the module connectors 50 act as a wireway. The light modules 14 may be connected in series or in parallel. In some embodiments, some of the LEDs 40 within a light module 14 are powered by cables feeding through a module connector 50 on a first end of the light module 14 and other LEDs with the light module 14 are powered by cables feeding through the module connector 50 located on the second, opposing end of the light module 14.

In other embodiments, power and/or communication is provided to a light module 14 wirelessly, such as via electromagnetic power transfer. By way only of example, electromagnetic induction may be used to transmit power to the light modules 14. In such embodiments, at least the module connectors 50 of a light module 14 should be made of a material (such as, but not limited to, non-ferrous metals and polymer-based materials) that does not substantially hinder electromagnetic power transmission. In such embodiments, wireways through the module connectors 50 may be unnecessary and indeed undesirable so as to prevent detrimental tampering with and/or ingress in the light modules 14.

In another embodiment, the driver(s) are not housed in the electronic compartment. Rather, a dedicated driver for a light module 14 resides in a module connector 50 for the light module 14. In this way, the light modules 14 are electronically autonomous. Each driver is powered by the main power supply entering the electronic housing 12 such that the light modules 14 are connected in parallel. In some embodiments, a driver is provided in the module connectors 50 on each end of a light module 14.

The module connectors 50 may be formed as a separate structure that is subsequently attached to the light modules 14. In some embodiments, however, at least a portion of the module connectors 50 may be formed integrally with the light modules 14. By way only of example (see FIG. 6), a connector base 58 may be formed integrally with the light module base 36 and extend from each end of the light module 14, as shown in FIG. 6. For example, the light module base 36, angled side walls 38, and connector base 58 could be stamped from metal and then bent to assume the desired shape.

A connector cover 60 is provided over the connector base 58 to form the module connector 50, as shown in FIG. 6. The connector cover 60 may be formed integrally with the connector base 58 or may be formed separately and then subsequently attached to the connector base 58, such as via mechanical fasteners. In one embodiment, the connector cover 60 may be hingedly attached to the connector base 58 so as to permit access to the inside of the module connector 50 should servicing or replacement of the wires or other electronics be required.

In some embodiments, a protective flap 66 (best seen in FIG. 1) is provided on the module connectors 50 and extends toward the LEDs 40. Wires for driving the LEDs 40 of a light module 14 may be fed from the module connector 50 under the protective flap 66 and connected to the LEDs 40. The protective flap 66 serves to shield those connections and can be rendered highly reflective to enhance light reflection from the light module 14 as well.

The innermost light modules 14 (light modules 14*b* and 14*c* in the illustrated embodiment) are connected to the electronic housing 12 via the module connectors 50. In some embodiments, the module connectors 50 are mechanically fastened to the electronic housing 12 such as via screws or other fasteners, adhesives, magnetic attraction or any other suitable means. Similarly, any subsequent light modules 14 added to the fixture are connected in series to adjacent light modules 14 via the module connectors 50. By way of example, tabs 68 may be provided on and extend from the module connectors 50. While tabs 68 are only shown extending from one side (side 52) of the module connectors 50, they can extend from either or both sides 52, 54. Holes in the tabs 68 may receive fasteners to attach the module connectors 50 to the electronic housing 12 or to adjacent light modules 14. However, other fastening means are contemplated. By way only of example, light modules 14 may be designed to snap fit onto the electronic housing 12 or onto other light modules 14. Such snap-fit connection may effectuate mechanical connection and in some embodiments may also effectuate electrical connection such that the light modules 14 are connected in series. In some embodiments, the light modules 14 include a means for attaching to either the electronic housing 12 or another light module 14 as well as a means for being attached to by the electronic housing 12 or another light module 14.

The structural components of the light fixture 10 (electronic housing 12, light modules 14, module connectors 50) may be formed of any material having suitable structural integrity and rigidity, including polymeric and metallic materials. In some embodiments, the components are formed from materials also having suitable thermal management capabilities so as to conduct heat generated by the LEDs 40. Metallic materials, such as but not limited to steel and aluminum, may be particularly suitable. The components of the fixture can, but need not, be formed from the same materials. Moreover, the components may be formed using a variety of different technologies, including, but not limited to, extrusion, roll-forming, die-forming, stamping, casting, etc.

In some embodiments, the light modules 14 are positioned a distance from the electronic housing 12 and each other so that air gaps 70 are formed between adjacent light modules 14 and the electronic housing 12. These air gaps 70 help avoid creation of a thermal path between the light modules 14 and the electronic housing 12 and thus help to thermally isolate these components.

In use, heat generated by the LEDs 40 is conducted and spread to the light module base 36 and angled side walls 38 for conductive cooling. Cooler air from below the fixture is permitted to move through the air gaps 70 and circulate around the light modules 14, carrying away heat during such movement. Thus, heat dissipation from the light fixture 10 results both from conduction of heat from the LEDs 40 as well as conduction and convection of heat from a light module 14 to the air circulating through and around the light module 14.

The light modules 14 may be provided in any length. Moreover, the light fixture 10 may be easily tailored to provide the desired lumen output by adding or removing light engines from the light fixture 10. Such customization may be accomplished during original manufacture of the light fixture 10 or on a light fixture 10 installed in the field. Providing light engines that are self-contained and all the same facilitate this customization process.

While the light modules 14 are illustrated as all oriented parallel within the light fixture 10, they need not be. Rather, the light modules 14 may extend at angles (e.g., at 90°) relative to the electronic housing 12 and/or other light modules 14 within the light fixture 10. In this way, the light modules may form a variety of different fixture shapes and geometries. One of skill in the art would understand how to modify the design of the module connectors 50 to effectuate these different orientations. Moreover, the number of light modules 14 and/or orientation of the light modules 14 need not be the same on each side of the electronic housing 12.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

We claim:

1. A light fixture comprising:

an electronic housing comprising:

a first electronic housing lateral side and a second electronic housing lateral side opposite the first electronic housing lateral side;

a first electronic housing longitudinal side and a second electronic housing longitudinal side opposite the first electronic housing longitudinal side, wherein a distance between the first electronic housing lateral side and the second electronic housing lateral side defines an electronic housing length extending along an electronic housing axis, wherein a distance between the first electronic housing longitudinal side and the second electronic housing longitudinal side defines an electronic housing width, and wherein the electronic housing length is greater than the electronic housing width; and a first light module and a second light module, each comprising:

a light module base comprising:

a first base lateral side and a second base lateral side opposite the first base lateral side;

a first base longitudinal side and a second base longitudinal side opposite the first base longitudinal side, wherein a distance between the first base lateral side and the second base lateral side defines a light module length extending along a light module axis, wherein a distance between the first base longitudinal side and base longitudinal side defines a light module width, and wherein the light module length is greater than the light module width;

a plurality of light emitters provided on the light module base; and a first light module connector provided proximate the first base lateral side and a second light module connector provided proximate the second base lateral side, wherein:

the first light module connector of each of the first light module and the second light module is connected to the electronic housing proximate the first electronic housing lateral side;

the second light module connector of each of the first light module and the second light module is connected to the electronic housing proximate the second electronic housing lateral side, wherein the first light module connector of each of the first light module and the second light module is more proximate to the first base lateral side than the second light module connector and more proximate to the first electronic housing lateral side than the second light module connector, and wherein the second light module connector of each of the first light module and the second light module is more proximate to the second base lateral side than the first light module connector and more proximate to the second electronic housing lateral side than the first light module connector; and the first light module and the second light module are connected to the electronic housing such that:

the electronic housing is interposed between the first light module and the second light module;

the electronic housing axis, the light module axis of the first light module, and the light module axis of the second light module all extend parallel to each other; and a first air gap is defined between the first electronic housing lateral side and the first base lateral side of the first light module and a second air gap is defined between the second electronic housing lateral side and the first base lateral side of the second light module.

2. The light fixture of claim 1, wherein the first and second light modules are removably attached to the electronic housing.

3. The light fixture of claim 1, wherein the electronic housing houses at least one driver.

4. The light fixture of claim 1, wherein the first light module connector of at least one of the first and second light modules houses at least one driver.

5. The light fixture of claim 1, wherein the first light module connector of at least one of the first and second light modules comprises a connector base and a connector cover positioned over the connector base.

6. The light fixture of claim 5, wherein the connector base is integral with the light module base.

7. The light fixture of claim 5, wherein the connector cover is non-integral with the light module base and attached to the connector base.

8. The light fixture of claim 7, wherein the connector cover is hingedly attached to the connector base.

9. The light fixture of claim 1, further comprising a third light module attached to the first light module such that it is not directly attached to the electronic housing.

10. The light fixture of claim 9, wherein the third light module is attached to the first light module via first light module connector of the first light module.

11. The light fixture of claim 10, wherein a light module axis of the third light module extends substantially parallel to the light module axis of the first light module and wherein the third light module is positioned a distance from the first light module such that an air gap is formed between the third light module and the first light module.

12. The light fixture of claim 9, wherein the electronic housing houses a driver that powers at least some of the light emitters of the first light module and of the third light module.

13. The light fixture of claim 9, wherein the third light module comprises a plurality of light emitters, wherein the first light module connector of the first light module houses a driver that powers at least some of the light emitters of the first light module and wherein a light module connector of the third light module houses a driver that powers at least some of the light emitters of the third light module.

14. The light fixture of claim 1, wherein:

the first light module connector of the first and second light modules comprises a passageway that extends at least partially through the first light module connector.

15. A method of altering a lumen output of an original light fixture comprising:

providing the original light fixture, wherein the original light fixture comprises:

an electronic housing comprising:

a first electronic housing lateral side and a second electronic housing lateral side opposite the first electronic housing lateral side, wherein a distance between the first electronic housing lateral side and the second electronic lateral side defines an electronic housing length extending along an electronic housing axis; and a first electronic housing longitudinal side and a second electronic housing longitudinal side opposite the first electronic housing longitudinal side, wherein a distance between the first electronic housing longitudinal side and the second electronic housing longitudinal side defines an electronic housing width that is less than the electronic housing length;

a first light module and a second light module, each comprising:

a light module base comprising:

a first base lateral side and a second base lateral side opposite the first base lateral side, wherein a distance between the first base lateral side and the second base lateral side defines a light module length extending along a light module axis;

a first base longitudinal side and a second base longitudinal side opposite the first base longitudinal side, wherein a distance between the first base longitudinal side and the second base longitudinal side defines a light module width that is less than the light module length;

a first light module connector proximate the first base lateral side and a second light module connector proximate the second base lateral side, wherein the first light module connector of each of the first light module and the second light module is more proximate to the first base lateral side than the second light module connector and more proximate to the first electronic housing lateral side than the second light module connector, and wherein the second light module connector of each of the first light module and the second light module is more proximate to the second base lateral side than the first light module connector and more proximate to the second electronic housing lateral side than the first light module connector; and a plurality of light emitters provided on the light module base, wherein the original light fixture has a maximum lumen output, and wherein the method comprises converting the original light fixture into a modified light fixture by:

attaching a third light module to the first light module such that the third light module is not directly attached to the electronic housing, wherein the modified light fixture has a maximum lumen output that is greater than the maximum lumen output of the original light fixture.

16. The light fixture of claim 10, wherein a light module axis of the third light module extends at a non-parallel angle relative to the light module axis of the first light module.

* * * * *